US009653801B2

(12) United States Patent
Milroy

(10) Patent No.: US 9,653,801 B2
(45) Date of Patent: May 16, 2017

(54) SELECTABLE LOW-GAIN/HIGH-GAIN BEAM IMPLEMENTATION FOR VICTS ANTENNA ARRAYS

(71) Applicant: ThinKom Solutions, Inc., Torrance, CA (US)

(72) Inventor: William Milroy, Torrance, CA (US)

(73) Assignee: THINKOM SOLUTIONS, INC., Hawthorne, CA (US)

( * ) Notice: Subject to any disclaimer, the term of this patent is extended or adjusted under 35 U.S.C. 154(b) by 366 days.

(21) Appl. No.: 14/104,466

(22) Filed: Dec. 12, 2013

(65) Prior Publication Data

US 2015/0171515 A1 Jun. 18, 2015

(51) Int. Cl.

| | |
|---|---|
| ***H01Q 3/16*** | (2006.01) |
| ***H01Q 3/04*** | (2006.01) |
| ***H01Q 3/32*** | (2006.01) |
| ***H01Q 21/00*** | (2006.01) |
| ***H01Q 25/00*** | (2006.01) |
| ***H01Q 15/24*** | (2006.01) |

(52) U.S. Cl.

CPC ..... *H01Q 3/16* (2013.01); *H01Q 3/04* (2013.01); *H01Q 3/32* (2013.01); *H01Q 15/24* (2013.01); *H01Q 21/0031* (2013.01); *H01Q 25/002* (2013.01)

(58) Field of Classification Search

CPC ..... H01Q 3/16; H01Q 3/04
USPC ..... 343/756; 333/327
See application file for complete search history.

(56) References Cited

U.S. PATENT DOCUMENTS

| | | | | |
|---|---|---|---|---|
| 4,322,699 | A * | 3/1982 | Hildebrand | H01Q 13/203 333/237 |
| 5,266,961 | A * | 11/1993 | Milroy | H01Q 13/28 343/767 |
| 5,276,452 | A * | 1/1994 | Schuss | H01Q 21/0025 342/371 |
| 5,349,363 | A | 9/1994 | Milroy | |
| 6,919,854 | B2 | 7/2005 | Milroy | |
| 7,205,948 | B2 * | 4/2007 | Krikorian | H01Q 21/0031 343/753 |
| 2004/0164915 | A1 | 8/2004 | Quan et al. | |

(Continued)

OTHER PUBLICATIONS

Extended European Search Report for corresponding European Application No. 14195954.4 dated Apr. 23, 2015.

*Primary Examiner* — Dameon E Levi
*Assistant Examiner* — Walter Davis
(74) *Attorney, Agent, or Firm* — Renner, Otto, Boisselle & Sklar, LLP.

(57) ABSTRACT

An antenna array employing continuous transverse stubs as radiating elements includes a first conductive plate structure including a first set of continuous transverse stubs arranged on a first surface, and a second set of continuous transverse stubs arranged on the first surface, wherein a geometry of the first set of continuous transverse stubs is different from a geometry of the second set of continuous transverse stubs. A second conductive plate structure is disposed in a spaced relationship relative to the first conductive plate structure, the second conductive plate structure having a surface parallel to the first surface. A relative rotation apparatus imparts relative rotational movement between the first conductive plate structure and the second conductive plate structure.

17 Claims, 12 Drawing Sheets

(56) References Cited

U.S. PATENT DOCUMENTS

2004/0233117 A1* 11/2004 Milroy ..... H01Q 3/04
343/770
2006/0267850 A1 11/2006 Krikorian et al.

* cited by examiner

FIG. 2A
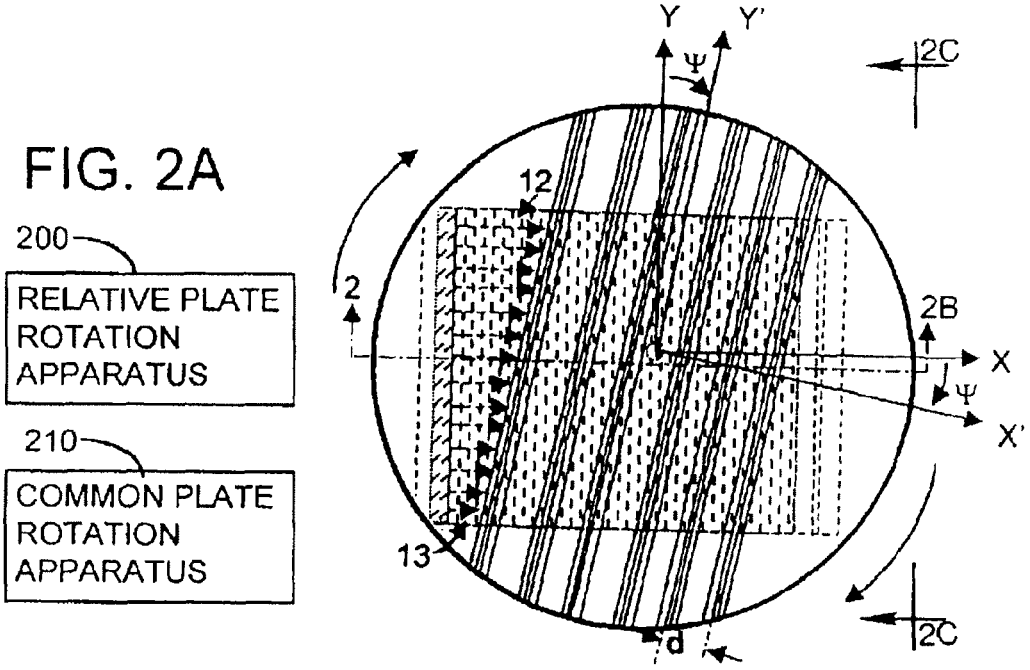
FIG. 2B
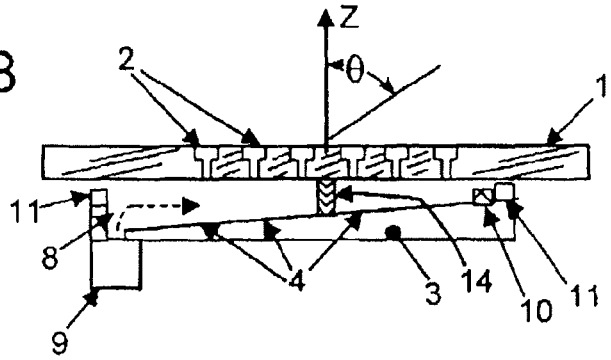
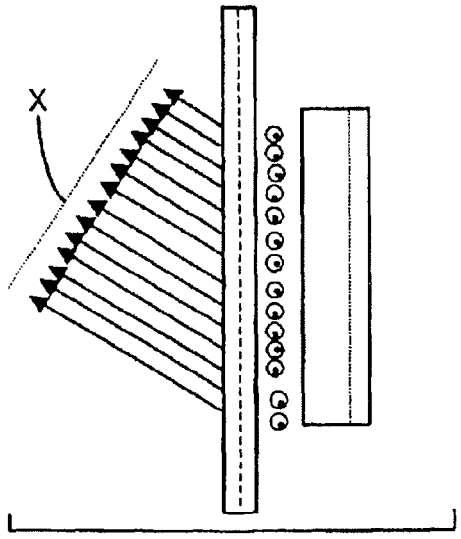
FIG. 2C

SELECTABLE LOW-GAIN/HIGH-GAIN BEAM IMPLEMENTATION FOR VICTS ANTENNA ARRAYS

TECHNICAL FIELD

This present invention relates generally to antennas and, more particularly, to an apparatus and method for realizing dual (switchable) antenna radiation patterns, each with distinct beam and sidelobe properties, as a variant of the conventional (single-beam) Variable Inclination Continuous Transverse Stub (VICTS) array.

BACKGROUND ART

In an important subset of antenna subsystem applications, it is often desired to support both high-gain (e.g., generally narrow beamwidth) and lower gain (generally broader beamwidth/coverage) functions. For example, when communicating with a remote mobile (e.g., airborne) terminal at or near the maximum range, it is desirable to provide the narrowest (highest gain) antenna pattern attributes in order to support the highest possible data rates. In such "maximum range" cases, the "target" (e.g., a remote terminal) is generally moving at a low angular rate (due to its distance from the "user" (e.g., a local terminal) and therefore the narrow nature of the antenna beam does not present a challenge in terms of the ability of the user to "track" the (moving) remote terminal.

Conversely, when operating at or near the minimum range, the required gain is significantly reduced (due to the diminished range between user and remote terminals) while the angular tracking rate is often dramatically increased (due to the near in location and geometry of the fixed user and moving remote). A broader (lower-gain, but easier to track) antenna pattern is generally preferred in the latter (minimum range) case while a narrower (high-gain, but more difficult to track) antenna pattern is preferred in the former case.

Similarly, in systems which must first acquire a target (e.g., a remote user) before tracking, it is often desirable/advantageous to use a broader antenna beam pattern in order to perform the acquisition function (thereby better accommodating a generally poorer a priori knowledge of the exact target location and pointing angles) before switching to a narrower (higher-gain) "tracking" antenna pattern once the initial acquisition is successfully completed.

The aforementioned communication link scenarios and problem statements are very similar in the cases of typical radar and electronic warfare (i.e., "jamming") systems which also require both maximum range (minimum angular rate) and minimum range (maximum angular rate) scenarios as well as (wide-beam) "acquisition" and (narrow-beam) "tracking" modes. All share a common benefit from the antenna subsystems ability to provide both selectable narrow- and broad-beam modes.

In a subset of the aforementioned cases, it may be desirable to support different antenna polarization properties such as opposite senses of circular polarization ("left-hand" and "right-hand") for the two selectable antenna pattern modes. In addition, it is often desirable to provide specific tailored antenna pattern characteristics in the "switched" beam pattern, including selective null-filling (to ensure constant communication), alternate or offset pointing angles (to accommodate varying target geometries), and/or alternate frequency bands of operation (for example, to support switchable Transmit and Receive operation).

Conventional means for realizing the desired dual switchable antenna beam (with dual-polarization, as an option) capabilities include use of two distinct antennas, using a switchable planar array antenna, or using an electronically-scanned antenna.

The "two distinct antennas" approach utilizes two distinct standalone antennas, each tailored to the desired beam properties. A mechanical or electronic switch is then employed to allow for "selection" of the desired antenna beam (antenna subsystem). The resultant "two-antenna" system is bulkier, more expensive, and (in some cases, due to the requisite switch) less capable in terms of power-handling when compared to a single VICTS antenna.

Regarding the switchable planar array antenna, a single planar array antenna is partitioned into two separate antenna apertures which may be switched via an array-mounted switch. This method suffers from the same drawbacks as the aforementioned two distinct antennas solution.

Finally, the electronically-scanned antenna (ESA) can include discrete phase (and in some cases, amplitude) control of individual radiating elements. This control can be employed to selectably switch between narrow and wide beam patterns. However, the added complexity, size, weight, power, and costs of an ESA implementation as compared to a VICTS is significant.

SUMMARY OF INVENTION

The present disclosure provides an apparatus and method for realizing dual (switchable) antenna radiation patterns as a variant of the conventional (single-beam) Variable Inclination Continuous Transverse Stub (VICTS) array. Each antenna radiation pattern may have distinct beam and sidelobe properties. The single integrated antenna embodiment replaces what would otherwise require two separate antenna subsystems in order to accomplish the same functionality. Further, the apparatus and method in accordance with the present disclosure can use existing actuators (e.g., two motors) of a conventional VICTS antenna without any additional complexity or components (i.e., no additional motors or switches), thereby preserving the inherent low-cost, low-profile, and high-power handling capabilities associated with conventional VICTS antennas.

Candidate fields of usage for the apparatus and method in accordance with the present invention include any communication, radar, or electronic warfare system that requires or would benefit from the capability of supporting the ability to provide two distinct switchable antenna beams from a single integrated VICTS structure. Specific applications include but are not limited to: Line-of-Sight (LOS) communication systems, Beyond-Line-of-Sight (BLOS) SATCOM communication systems, ground and airborne radar systems, and airborne, shipboard, and ground electronic warfare systems.

According to one aspect of the invention, an antenna array employing continuous transverse stubs as radiating elements includes: a first conductive plate structure including a first set of continuous transverse stub radiators arranged on a first surface, and a second set of continuous transverse stub radiators arranged on the first surface, wherein a geometry of the first set of continuous transverse stub radiators is different from a geometry of the second set of continuous transverse stub radiators; a second conductive plate structure disposed in a spaced relationship relative to the first conductive plate structure, the second conductive plate structure having a surface parallel to the first surface; and a relative rotation apparatus operative to impart relative rotational movement between the first conductive plate structure and the second conductive plate structure.

According to one aspect of the invention, the antenna array includes a feed network for transmitting or receiving a signal to or from the first conductive plate, wherein the relative rotation apparatus is operative to rotate the first plate to position one of the first set of continuous transverse stub radiators or the second set of continuous transverse stub radiators into proximity of the feed network.

According to one aspect of the invention, a first pitch of the radiating structures of the first set of continuous transverse stub radiators is different from a second pitch of the radiating structures of the second set of continuous transverse stub radiators.

According to one aspect of the invention, the first pitch and second pitch are uniform.

According to one aspect of the invention, a first pitch of the first set of continuous transverse stub radiators is periodic, and a second pitch of the second set of continuous transverse stub radiators is aperiodic.

According to one aspect of the invention, a width of the stub radiators of the first set of continuous transverse stub radiators is less than a width of the stub radiators of the second set of continuous transverse stub radiators.

According to one aspect of the invention, a height of the stub radiators of the first set of continuous transverse stub radiators is less than a height of the stub radiators of the second set of continuous transverse stub radiators.

According to one aspect of the invention, the stub radiators of the first set of continuous transverse stub radiators are arranged in straight sections, and the stub radiators of the second set of continuous transverse stub radiators are arranged in curved sections.

According to one aspect of the invention, the second set of continuous transverse stub radiators have non-uniform spacing.

According to one aspect of the invention, the second set of continuous transverse stub radiators have non-uniform height or cross section.

According to one aspect of the invention, a geometry of the second set of continuous transverse stub radiators differs from a geometry of the first set of continuous transverse stub radiators in at least one of size, height, thickness, spacing, or shape.

According to one aspect of the invention, at least one of the first set of continuous transverse stub radiators or the second set of continuous transverse stub radiators are non-uniform in at least one of height or cross-section.

According to one aspect of the invention, the second set of continuous transverse stub radiators is arranged at an inner or outer perimeter of the first conductive plate.

According to one aspect of the invention, the antenna array includes a first polarizer corresponding to the first set of continuous transverse stub radiators.

According to one aspect of the invention, the antenna array includes a second polarizer corresponding to the second set of continuous transverse stub radiators, the first polarizer different from the second polarizer.

According to one aspect of the invention, a method is provided for using a variable inclination continuous transverse stub (VICTS) antenna array to provide a first antenna pattern and a second antenna pattern different from the first antenna pattern. The VICTS array includes a feed network for transmitting and/or receiving a signal via radio frequency (RF) coupling, and a conductive plate structure having a first set of continuous transverse stub radiators arranged on a first surface and a second set of continuous transverse stub radiators arranged on the first surface, wherein a geometry of the first set of continuous transverse stub radiators is different from a geometry of the second set of continuous transverse stub radiators. The method includes: generating the first antenna pattern by positioning the conductive plate structure relative to the feed network to RF couple the first set of continuous transverse stub radiators to the feed network; and generating the second antenna pattern by positioning the conductive plate structure relative to the feed network to RF couple the second set of continuous transverse stub radiators to the feed network.

To the accomplishment of the foregoing and related ends, the invention, then, comprises the features hereinafter fully described and particularly pointed out in the claims. The following description and the annexed drawings set forth in detail certain illustrative embodiments of the invention. These embodiments are indicative, however, of but a few of the various ways in which the principles of the invention may be employed. Other objects, advantages and novel features of the invention will become apparent from the following detailed description of the invention when considered in conjunction with the drawings.

BRIEF DESCRIPTION OF DRAWINGS

In the annexed drawings, like references indicate like parts or features.

FIG. 2A is a top view similar to FIG. 1A, but with the upper plate rotated relative to the bottom plate.

FIG. 2B is a cross-sectional view taken along line 2B-2B of FIG. 2A.

FIG. 2C illustrates the radiated electromagnetic phase front resulting from the antenna orientation of FIG. 2A.

DETAILED DESCRIPTION OF INVENTION

Figure 1A:
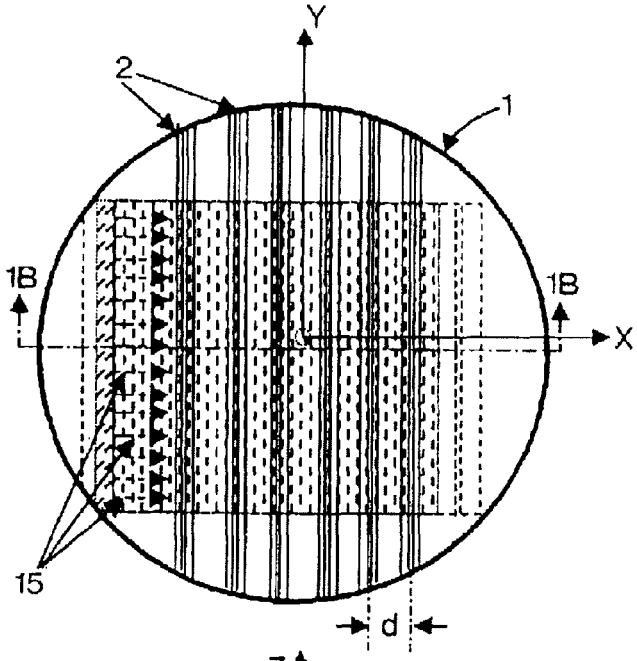
FIG. 1A is a top view of a portion of an exemplary embodiment of a VICTS.

A VICTS antenna array typically includes two plates, one (upper) having a one-dimensional lattice of continuous radiating stubs and the second (lower) having one or more line sources emanating into the parallel-plate region formed and bounded between the upper and lower plates. Mechanical rotation of the upper plate relative to the lower plate serves to vary the inclination of incident parallel-plate modes, launched at the line source(s), relative to the continuous transverse stubs in the upper plate, and in doing so constructively excites a radiated planar phase-front whose angle relative to the mechanical normal of the array (theta) is a simple continuous function of the relative angle ($\psi$) of (differential) mechanical rotation between the two plates. Common rotation of the two plates in unison moves the phase-front in the orthogonal azimuth (phi) direction.

Accordingly, the radiating stub aperture of the conventional VICTS antenna is comprised of a collection of identical, parallel, uniformly-spaced radiating stubs over its entire surface area. The stub aperture serves to couple energy from a parallel-plate region (formed between the upper-most conductive surface of the array network and the lower-most conductive surface of the radiating stub aperture structure).

The VICTS array in accordance with the present disclosure employs an additional (different) radiating stub geometry that can vary from the primary stub geometry, for example, in size, height, thickness, spacing, shape, and/or coupling properties over a minority area of the radiating aperture. The minority area of the radiating aperture can be located at or near perimeter (e.g., an inner or outer perimeter) of one of the conducting plates, and can be generally located in an area furthest away (opposite) from the VICTS feed network. "Switching" is performed by mechanically rotating the upper radiating stub aperture (by approximately 180 degrees, and employing the same motor mechanism used in the conventional VICTS beam-steering mechanism) in order to bring the modified perimeter of the radiating stub aperture into proximity to the VICTS feed network, thereby "activating" the secondary beam mode. In this way (utilizing the existing mechanical mechanism) the switchable beam capability is uniquely enabled without the need for added switching components or complexity.

As an option, the minority area of the radiating stub aperture may have a different polarizer employed than that over the majority area of the aperture. Also, the specific physical properties of the radiating stubs in the minority area can be tailored to provide the desired broad-beam properties in the (secondary beam), while having a negligible or minimum impact on the majority (primary beam) characteristics.

As compared to the aforementioned Non-VICTS technologies, the dual-beam implementation in accordance with the present disclosure obviates the need to utilize two individual antennas (plus requisite switching mechanism) and as compared to the ESA technology, provides the desired dual-beam capability and functionality, while preserving the unique beneficial size, weight, cost, and power-handling properties of the conventional VICTS array.

As contrasted to the generic Dual-Antenna and Switchable Planar Antenna solutions, the apparatus in accordance with the present disclosure provides a simple low-cost and compact integrated implementation for accomplishing the desired dual-beam capability, without need to increase size, add complexity, or introduce additional switching and beam-steering components. As compared to the ESA solution, the apparatus in accordance with the present disclosure preserves the proven size, weight, power, and cost advantages of the VICTS antenna, while providing the desired dual-beam functionality.

Referring now to FIG. 1A, an exemplary variable inclination continuous transverse stub (VICTS) array is illustrated in a rectangular X, Y, Z coordinate frame of reference. FIG. 1A is a top view of a conductive upper plate 1 and a lower conductive plate 3, shown disposed in a plane parallel to the X-Y plane. The upper plate 1 contains a set of identical, equally spaced, Continuous Transverse Stub (CTS) radiators 2. CTS radiators are well known in the art, e.g., U.S. Pat. Nos. 5,349,363 and 5,266,961, which are hereby incorporated by reference in their entirety. Note that a total of six (6) stubs are shown as an example, although upper plates 1 containing more stubs, or alternatively less stubs may be deployed.

Figure 1B:
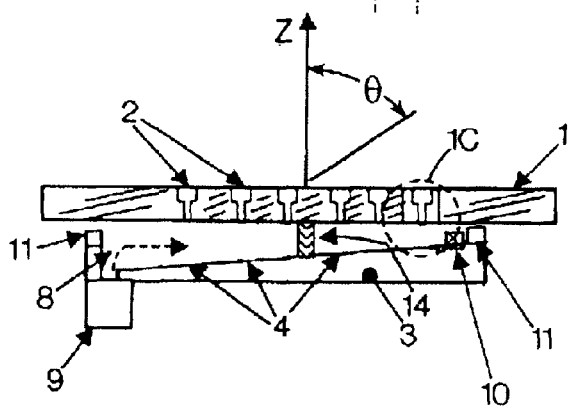
FIG. 1B is a simplified cross-sectional view taken along line 1B-1B of FIG. 1A.
Figure 1C:
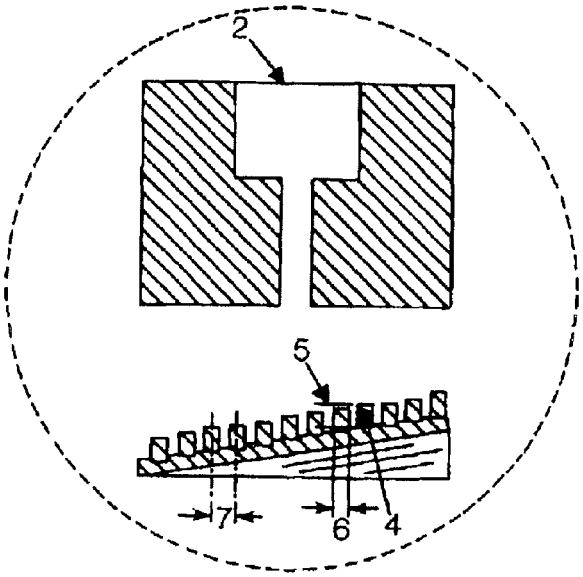
FIG. 1C is an enlargement of a portion of the embodiment illustrated in FIG. 1B.

FIG. 1B is a cross-sectional view taken along line 1B-1B of FIG. 1A, showing in cross-section the upper plate 1 and lower conductive plate 3. FIG. 1C is an enlarged view of a portion of FIG. 1B. The lower conductive plate 3 is made in such a way that its cross-section varies in height in the positive z-direction as a function of x-coordinate as shown. Both plates are located in X, Y, Z space in such a way that they are centered about the z-axis. An optional dielectric support 14 is disposed along the z-axis and acts as a support between the upper and lower plates.

The top surface of the lower plate 3 contains a number of rectangular shaped corrugations 4 with variable height 5, width 6, and centerline-to-centerline spacing 7. As shown in FIG. 1C, the corrugations 4 may, in some embodiments, be disposed with constant cross-section over the full length of the lower plate 3 in the y-direction, though they are typically variable (non-uniform).

The lower surface of plate 1 and the upper corrugated surface of plate 3 form a quasi-parallel plate transmission line structure that possesses plate separation that varies with x-coordinate. The transmission line structure is therefore periodically loaded with multiple impedance stage CTS radiating stubs 2 that are contained in plate 1. Further, plate 1 along with the upper surface of plate 3 form a series-fed CTS radiating array, including that the parallel plate spacing varies in one dimension and corrugations are employed to create an artificial dielectric or slow-wave structure.

Figure 1D:
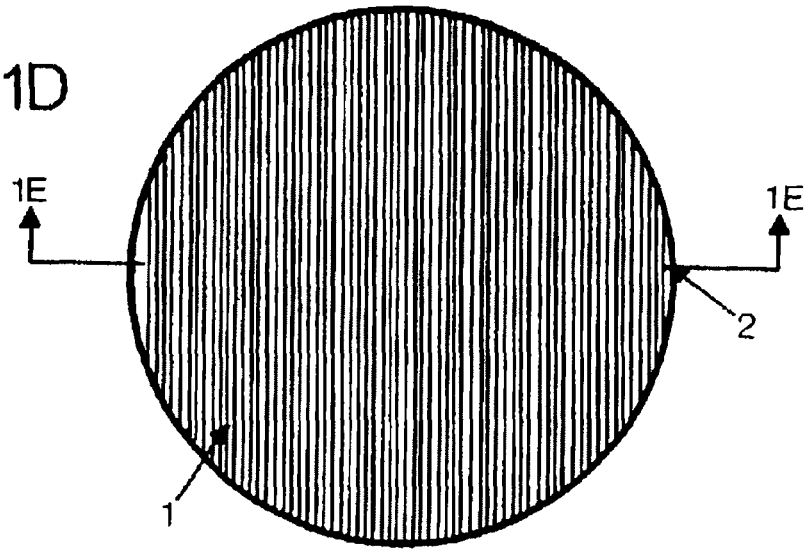
FIG. 1D is a top view of an alternate embodiment of a VICTS array employing an extrusion-based upper plate.
Figure 1E:
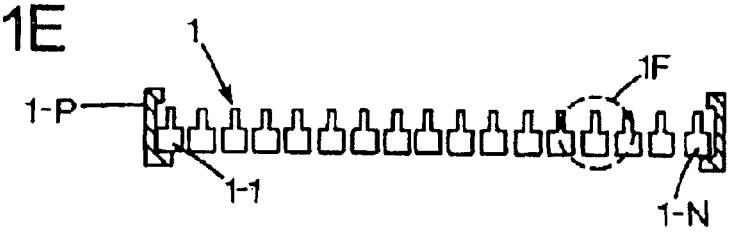
FIG. 1E is a cross-sectional view taken along line 1E-1E of FIG. 1D.
Figure 1F:
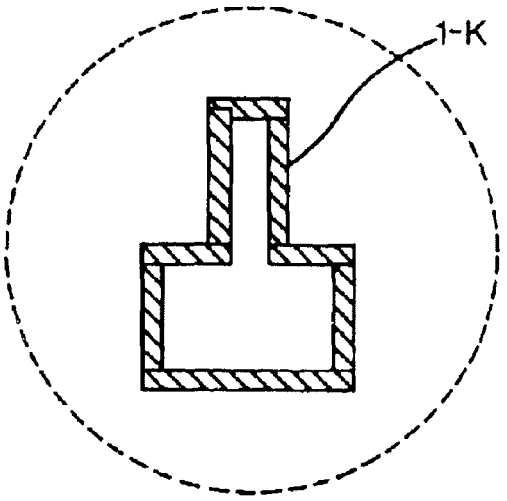
FIG. 1F is an enlargement of a portion of the embodiment illustrated in FIG. 1E.

The upper plate 1, shown in FIG. 1B as being fabricated from a solid conductive plate, can take different forms. For example, as shown in FIGS. 1D-1F, the upper plate can be fabricated as a set of closely spaced extrusions 1-1 to 1-N, with typical extrusion 1-K shown in the enlarged cross-sectional view of FIG. 1F, held together by a conductive or non-conductive frame 1-P.

The CTS array may be excited from below at one end 8 by a generic linear source 9 (also referred to as a feed network). Traveling-waves consisting of parallel-plate modes are created by the source between the lower surface of the upper plate and the upper surface of the lower plate. These modes propagate in the positive x-direction. Plane wave-fronts associated with these modes are contained in planes parallel to the Y-Z plane. Dotted arrows, 15, indicate the direction of rays associated with these modes in a direction perpendicular to the Y-Z plane.

As the traveling-waves propagate in the positive x-direction away from the linear source 9, corresponding longitudinal surface currents flow on the lower surface of the upper plate and the upper surface of the lower plate and corrugations in the positive x-direction. The currents flowing in the upper plate are periodically interrupted by the presence of the stub elements. As such, separate traveling waves are coupled into each stub that travel in the positive z-direction to the top surface of the upper plate and radiate into free space at the terminus of the uppermost impedance stage.

The collective energy radiated from all the stub elements causes an antenna pattern to be formed far away from the upper surface of the upper plate. The antenna pattern will show regions of constructive and destructive interference or side lobes and a main beam of the collective waves and is dependent upon the frequency of excitation of the waves and geometry the CTS array. The radiated signal will possess linear polarization with a very high level of purity. The stub centerline to centerline spacing, d, and corrugation dimensions 5, 6, and 7 (FIG. 1C), may be selected such that the main beam is shifted slightly with respect to the mechanical bore sight of the antenna defined by the z-axis.

Any energy not radiated into free space will dissipate in an RF energy-absorbing load 10 placed after the final stub in the positive x-direction. Non-contacting frictionless RF chokes, 11, placed before the generic linear source (negative x-direction) and after the RF energy-absorbing load (positive x-direction) prevent unwanted spurious radiation of RF energy.

If the upper plate 1 is rotated or inclined in a plane parallel to the X-Y plane as shown in FIG. 2A by some angle ψ, the effect of such a rotation is that the orientation of the stubs relative to the fixed incident waves emanating from the source is modified. As the waves travel away from the source towards the stubs, rays incident upon the stubs towards the top 12, (positive y-coordinate) of the parallel plate region arrive later in time than rays incident towards the bottom 13 of the parallel plate region (negative y-coordinate). Consequently, waves coupled from the parallel plate region to the stubs will possess a linear progressive phase factor along their length parallel to Y' and a smaller linear progressive phase factor perpendicular to their length along the X' axis. These two linear phase factors cause the radiated planar phase front x (FIG. 2C) from the antenna to make an angle with the mechanical bore sight (along the z-axis) of the antenna that is dependent on ψ. This leads to an antenna pattern whose main beam is shifted or scanned in space.

The amount of change in the linear progressive phase factors and correspondingly the amount of scan increases with increasing ψ. Further, both plates 1 and 3 may be rotated simultaneously to scan the antenna beam in azimuth. Overall, the antenna beam may be scanned in elevation angle, θ, from zero to ninety degrees and in azimuth angle, ψ, from zero to three hundred and sixty degrees through the differential and common rotation of plates 1 and 3 respectively. Moreover, the antenna beam may be continuously scanned in azimuth in a repeating three hundred and sixty-degree cycle through the continuous rotation of plates 1 and 3 simultaneously.

In general the required rotations for the above described embodiments may-be achieved through various means illustrated schematically in FIG. 2A as relative plate rotation apparatus 200 and common plate rotation apparatus 210, including but not limited to being belt driven, perimeter gear driven, or direct gear driven.

Thus, a CTS antenna provides a relatively thin, two dimensionally scanned phased array antenna. This is accomplished through a unique variable phase feeding system whose incident phase fronts are fixed while scanning is achieved by mechanically inclining (rotating) a set of CTS stubs.

The VICTS of FIGS. 1A-2C includes CTS stubs that possess constant radiating stub dimensions and variable parallel plate base dimensions. As plate 1 is rotated with respect to plate 3, the relative positions of all the stubs will change in such a way that the parallel plate separation for a given stub will be different than that at zero degrees rotation. Moreover the parallel plate separation will vary as a function of both X and Y. Since the effective coupling factor, $K_2$, is designed to be mostly constant with respect to rotation angle and varies only with plate separation, the overall coupling profile and corresponding amplitude distribution of the antenna will be mostly constant with respect to rotation angle. In this manner, the amplitude distribution is synthesized solely through the variation of the parallel plate separation in lieu of variations in the radiating stub dimensions. This attribute reduces the manufacturing complexity of the upper plate 1 since all of the stub dimensions are identical except for their length. Other geometries in which the cross-sectional stub dimensions (L1 . . . Ln, and b1 . . . bn) are not identical among stubs can also be employed and may be desirable for some applications. Additionally, embodiments in which stubs are non-uniformly spaced (i.e., d is non-constant from stub to stub) are possible and may be desirable for some applications.

Figure 3:
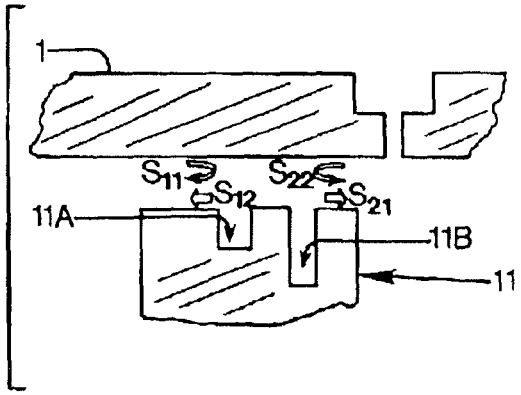
FIG. 3 illustrates a non-contacting choke utilized with CTS stubs for the embodiment of FIGS. 1A-2C.

As illustrated in FIGS. 1 and 2, a choke mechanism 11 is deployed to prevent spurious RF energy from escaping outside the physical boundaries of the antenna. An exemplary choke embodiment is shown in FIG. 3. In this embodiment, a coupled pair of CTS stubs 11A, 11B are deployed. The choke presents an extremely high impedance to any waves incident in the choke region such that $S_{11}$ and $S_{22}$ have magnitudes very close to one and $S_{12}$ and $S_{21}$ have magnitudes very close to zero. The choke provides good RF choking regardless of rotation angle and the choke performance may be designed to be virtually invariant with rotation angle over a given frequency range.

Figure 4A:
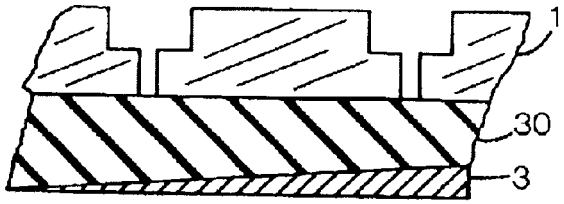
FIGS. 4A-4E depict alternative structures for achieving the dielectric constant between the plates 1 and 2.
Figure 4B:
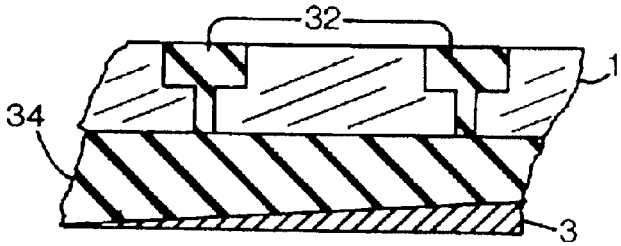
Figure 4C:
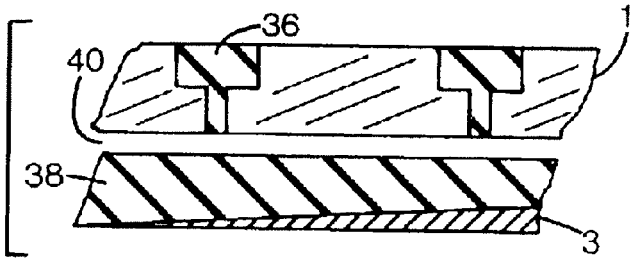
Figure 4D:
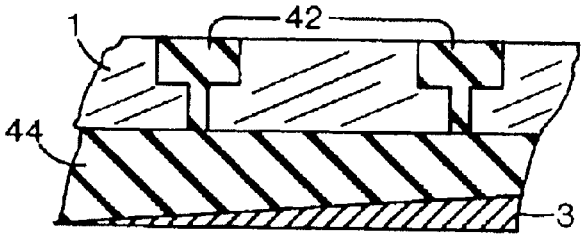
Figure 4E:
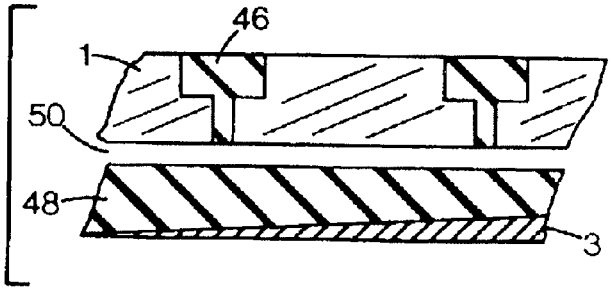

Alternative techniques may be used to load the region between the plates 1 and 3. FIGS. 4A-E show cut-away views of several possible embodiments including solid dielectric 30 in the parallel plate region (FIG. 4A), separate identical solid dielectrics 32, 34 in the stub and the plate regions (FIG. 4B), separate identical solid dielectrics 36, 38 in the stub and the plate region with an air gap 40 (FIG. 4C), separate non-identical solid dielectrics 42, 44 in the stub and the plate region (FIG. 4D), and separate non-identical solid dielectrics 46, 48 in the stub and the plate region with an air gap 50 (FIG. 4E). Other geometries are possible and may be useful for certain applications. Additional details concerning a VICTS array can be found in U.S. Pat. No. 6,919,854 issued to Milroy, the contents of which is hereby incorporated by reference in its entirety.

Figure 5:
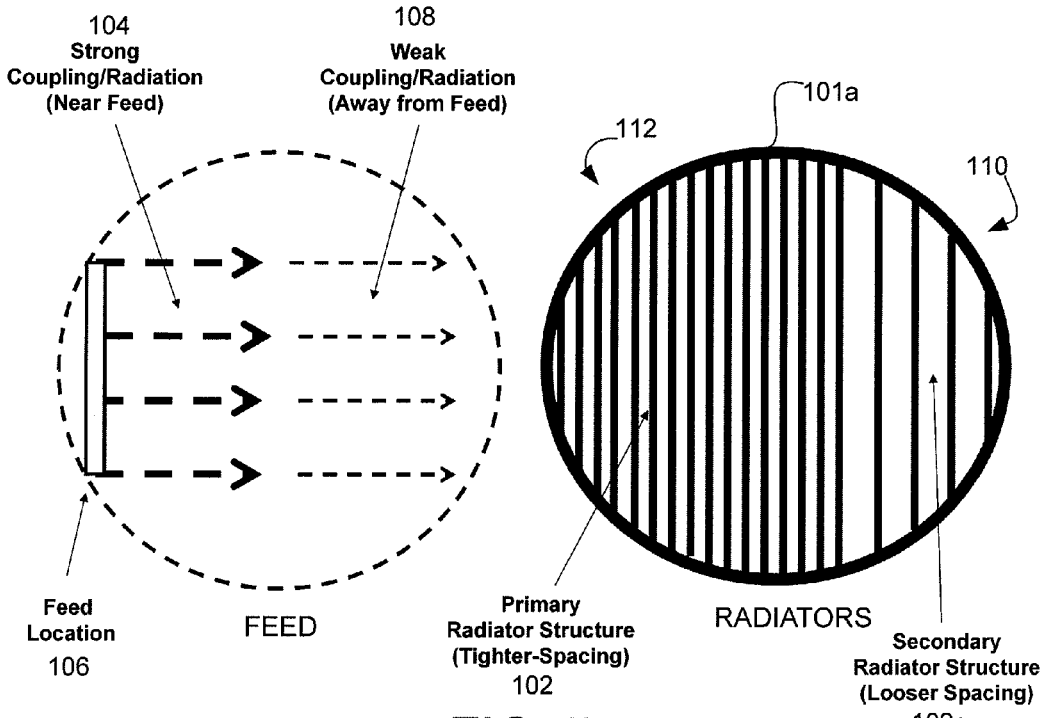
FIG. 5 illustrates VICTS feed network and radiator structures in accordance with the present disclosure.

With reference to FIG. 5, a right-most portion illustrates an exemplary first (upper) conductive plate 101*a* of a VICTS array in accordance with the present disclosure, and a left-most portion illustrates coupling along a surface of the conductive plate 101*a*. The first (upper) conductive plate 101*a* may replace the conductive upper plate 1 shown in FIGS. 1-4.

The first plate 101*a* includes a first (primary) set of continuous transverse stub radiators 102 arranged on a first surface of the plate 101, and a second (secondary) set of continuous transverse stub radiators 102*a* arranged on the first surface of the plate 101*a*. The first set of continuous transverse stub radiators 102 occupies a majority of the surface of the plate 101*a*, while the second set of continuous transverse stub radiators 102*a* occupies a minority of the surface of the plate 101*a*.

In accordance with the present disclosure, a geometry of the first set of continuous transverse stub radiators 102 is different from a geometry of the second set of continuous transverse stub radiators 102*a*. For example, the geometry of the second set of continuous transverse stub radiators 102*a* may differ from the geometry of the first set of continuous transverse stub radiators 102 in at least one of size, height, thickness, spacing, or shape. The first set of continuous transverse stub radiators 102 may be spaced apart so as to define a first pitch, and the second set of continuous transverse stub radiators 102*a* may be spaced apart so as to define a second pitch different from the first pitch. The first and/or second pitch may be uniform throughout (a uniform pitch) or at least one of the first or second pitch may vary (an aperiodic pitch). Alternatively, the first set of continuous transverse stub radiators 102 may be taller, shorter, thinner or thicker than the second set of continuous transverse stub radiators 102*a*. As shown in FIG. 5, strong coupling/radiation takes place in the region 104 near the VICTS feed network 106, and weakens as the distance from the feed network 106 increases (e.g., in the region 108 away from the feed network 106).

In FIG. 5, the stub radiators 102*a* in a minority area/region 110 of the first conductive plate 101*a* (shown generally opposite the feed network 106 when in "unselected mode") have been modified such that the stub radiators 102*a* are intentionally spaced at a different uniform pitch from a pitch of the stub radiators 102 in a majority region 112 of the first conductive plate 101*a*. Such variation in pitch between the primary stub radiators 102 and secondary stub radiators 102*a* provides a secondary beam that is offset in beam location relative to the primary beam at a common operating frequency, or alternatively supports aligned beams, but at different operating frequencies (transmit and receive operation, for example).

Figure 6A:
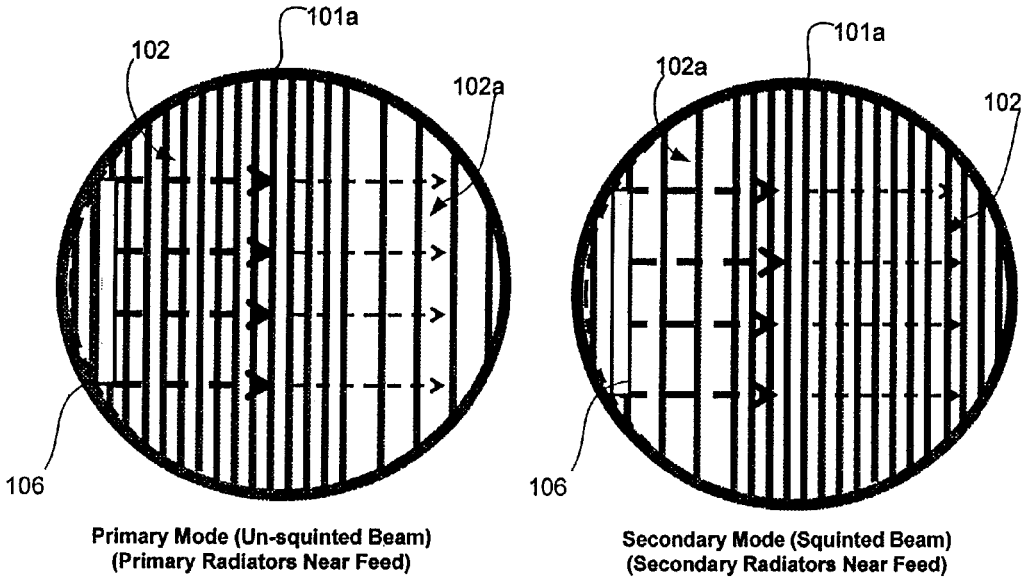
FIG. 6A illustrates primary and secondary mode switching via rotation of radiator structure, where a portion of the radiator structure has a different spacing than the remainder of the radiator structure.

With additional reference to FIG. 6A, the conductive plate 101*a* is shown in two different orientations relative to the feed network 106. More specifically, the left-most illustration shows the primary mode of operation, where the primary set of continuous transverse stub radiators 102 is near/adjacent the feed network 106 and the secondary set of continuous transverse stub radiators 102*a* is opposite the feed network 106. The right-most illustration of FIG. 6A illustrates the secondary mode of operation, where the secondary set of continuous transverse stub radiators 102*a* is near/adjacent the feed network 106 and the primary set of continuous transverse stub radiators 102 is opposite the feed network 106.

When the plate 101*a* is positioned as shown in the left-most illustration of FIG. 6A, the first set of continuous transverse radiating stub radiators 102 in the majority region 112 are more heavily coupled to the feed network 106, which provides a narrow beam and thus high-gain operation. When the plate 101*a* is positioned as shown in the right-most illustration of FIG. 6A, the second set of continuous transverse radiating stub radiators 102*a* in the minority region 110 are more heavily coupled to the feed network 106, which as noted above provides a secondary beam that is "squinted" (offset) in beam location relative to the primary bean at a common operating frequency, or alternatively supports aligned beams at different operating frequencies.

Figure 6B:
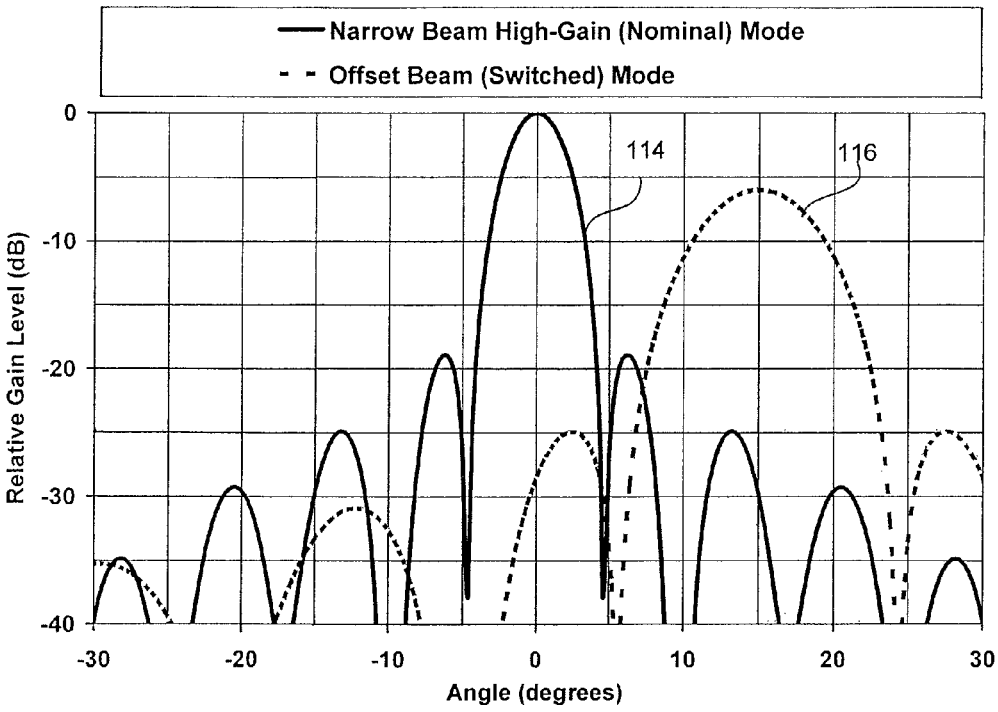
FIG. 6B is a graph showing the gain for a VICTS having the radiator structure of FIG. 6A, with one antenna pattern being narrow (higher-gain) and the other antenna pattern being broad (lower-gain) and having a beam position which is offset from the primary beam.

FIG. 6B illustrates the relative gain level over the angle in degrees, (i.e., "antenna pattern cut") measured in the E-plane or "X" direction of the antenna, for both the primary mode of operation (i.e., when the primary stub radiators 102 are proximal to the feed network 106 and the secondary stub radiators 102*a* are distal from the feed network 106) and the secondary mode of operation (i.e., when the secondary stub radiators 102*a* are proximal to the feed network 106 and the primary stub radiators 102 are distal from the feed network 106). As can be seen, the primary mode provides a narrow beam 114 having a high gain, while the secondary mode provides a wide beam 116 having a lower gain offset from the narrow beam.

Figure 7A:
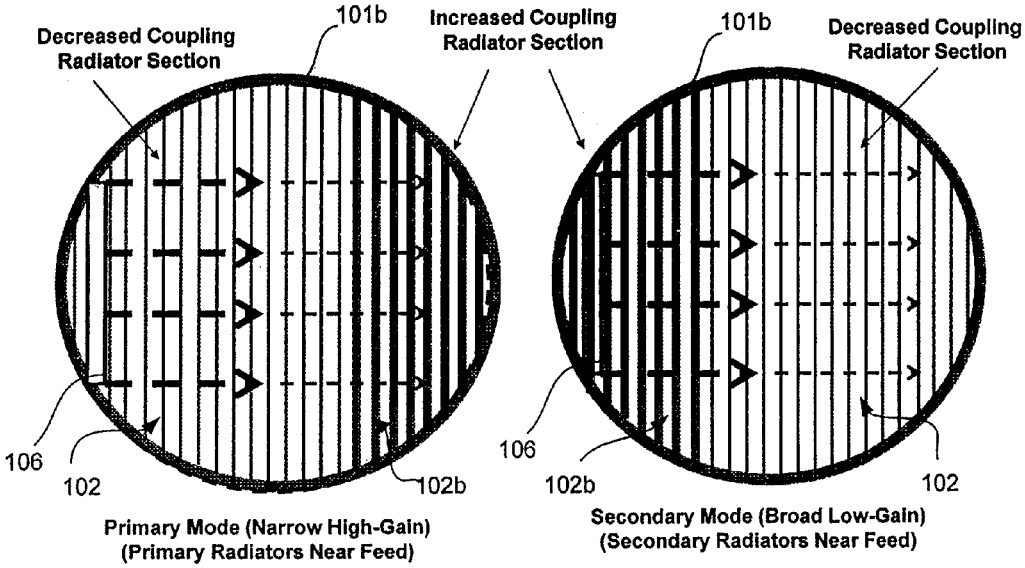
FIG. 7A illustrates primary and secondary mode switching via rotation of radiator structure, where a portion of the radiator structure has a different width than the remainder of the radiator structure.

Moving now to FIG. 7A, another exemplary first (upper) conductive plate 101*b* of a VICTS array in accordance with the present disclosure is illustrated. Again, the first (upper) conductive plate 101*b* may replace the conductive upper plate 1 shown in FIGS. 1-4. The first conductive plate 101*b* includes a first set of continuous transverse stub radiators 102 arranged on a first surface of the plate 101*b*, and a second set of continuous transverse stub radiators 102*b* arranged on the first surface of the plate 101*b*. The first set of continuous transverse stub radiators 102 occupies a majority of the surface of the plate 101*b*, while the second set of continuous transverse stub radiators 102*b* occupies a minority of the surface of the plate 101*b*.

Figure 7B:
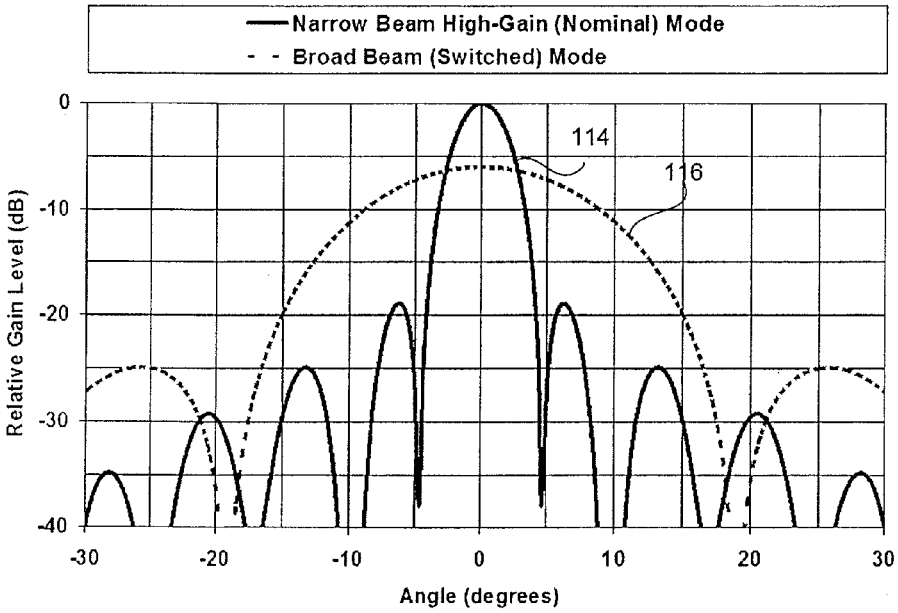
FIG. 7B is a graph showing the gain for a VICTS having the radiator structure of FIG. 7A, with one antenna pattern being narrow (higher-gain) and the other antenna pattern being broad (lower-gain).

The continuous transverse stub radiators 102 in the majority region have a first geometry, and the continuous transverse stub radiators 102*b* in the minority region have a second geometry that is different from the first geometry. For example, the continuous transverse stub radiators 102 may be thinner and/or taller than the continuous transverse stub radiators 102*b*. This results in the stub radiators 102*b* in the minority region being more heavily coupled than the stub radiators 102 in the majority region, which broadens the E-plane and/or H-plane of the antenna pattern. The additional coupling can be provided through appropriate selection of the parallel-plate spacing, stub height, stub spacing and intermediate stub coupling stage widths and heights. In some cases the total thickness of the radiating aperture local to the minority region may be different than employed in the majority region (e.g., the stubs may be non-uniform in height/cross section in order to provide additional degrees of freedom relative to the desired phase and coupling attributes). FIG. 7B illustrates the distinct individual properties of the two different antenna patterns, one pattern 118 being narrow (higher-gain) and one pattern 120 being wider and having an alternate operating frequency.

Figure 8A:
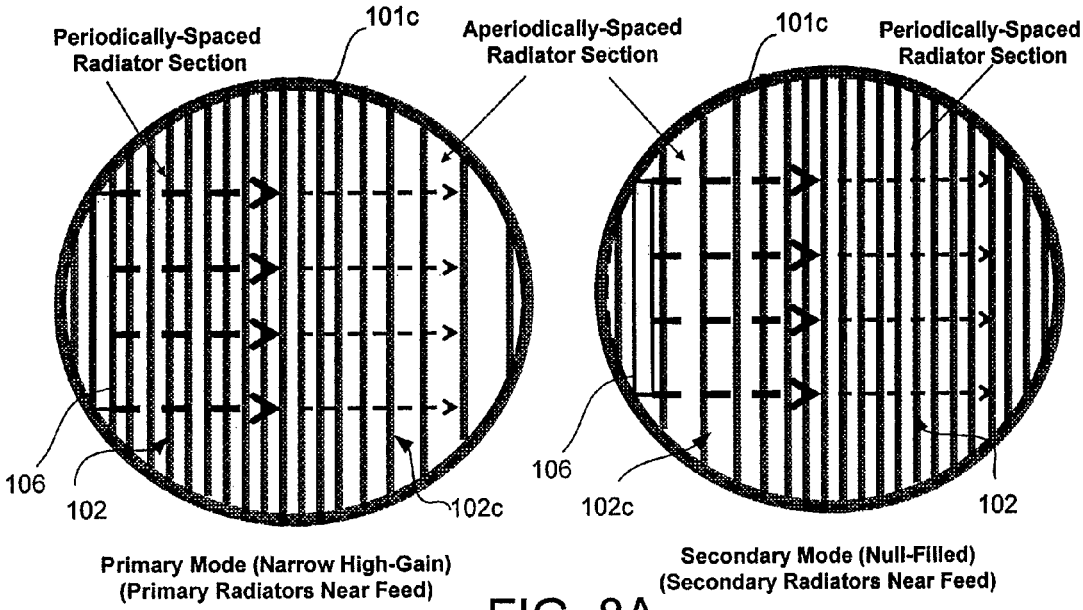
FIG. 8A illustrates primary and secondary mode switching via rotation of radiator structure, where a portion of the radiator structure has aperiodic spacing and the remainder of the radiator structure has periodic spacing.

Moving now to FIG. 8A, another exemplary first (upper) conductive plate 101*c* of a VICTS array in accordance with the present disclosure is illustrated. Like the other embodiments, the first (upper) conductive plate 101*c* may replace the conductive upper plate 1 shown in FIGS. 1-4. The first plate 101*c* includes a first set of continuous transverse stub radiators 102 arranged on a first surface of the plate 101*c*, and a second set of continuous transverse stub radiators 102*c* arranged on the first surface of the plate 101*c*. The first set of continuous transverse stub radiators 102 occupies a majority of the surface of the plate 101*c*, while the second set of continuous transverse stub radiators 102*c* occupies a minority of the surface of the plate 101*c*.

As can be seen in FIG. 8A, the first set of continuous transverse stub radiators 102 in the majority region have a fixed pitch (a first periodic pitch) while the second set of continuous transverse stub radiators 102*c* in the minority region do not have a fixed pitch but instead are non-uniformly spaced (aperiodic) in order to purposefully broaden and/or null-fill the (E-plane) antenna pattern. In other words, the first pitch of the first set of continuous transverse stub radiators 102 is different from a second pitch of the second set of continuous transverse stub radiators. This variable spacing is selected to provide desired non-uniform phase properties generally employed in null-filled antenna synthesis.

Figure 8B:
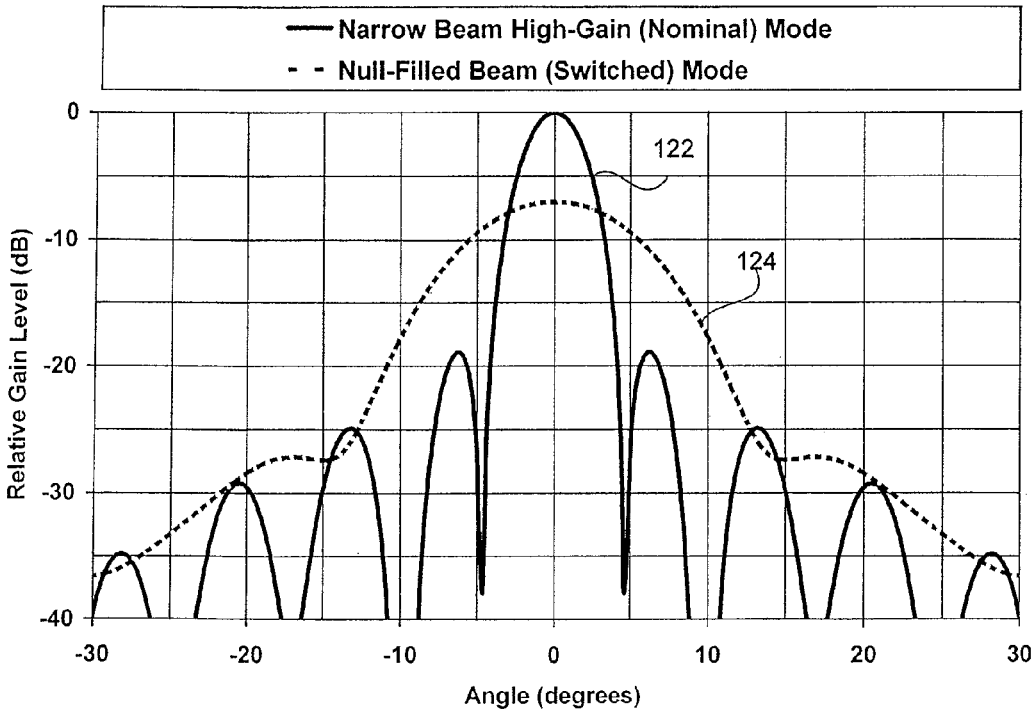
FIG. 8B is a graph showing the gain for a VICTS having the radiator structure of FIG. 8A, with one antenna pattern being narrow (higher-gain) and the other antenna pattern being broad (lower gain) with tailored null-filling.

When in the primary mode (i.e., the primary stub radiators 102 are proximal to the feed network 106 and the secondary stub radiators 102*c* are distal (opposite) the feed network 106), a narrow (high gain) antenna pattern results. When in the secondary mode (i.e., the secondary stub radiators 102*c* are proximal to the feed network 106 and the primary stub radiators 102 are distal (opposite) the feed network 106), a null-filled antenna pattern results. FIG. 8B illustrates the characteristics of the primary and secondary modes of operation, wherein one antenna patter 122 exhibits a narrow beam, and the other antenna pattern 124 exhibits a broader null-filled beam. Such configuration is advantageous in that it does not have any regions in which the signal may be lost.

Figure 9A:
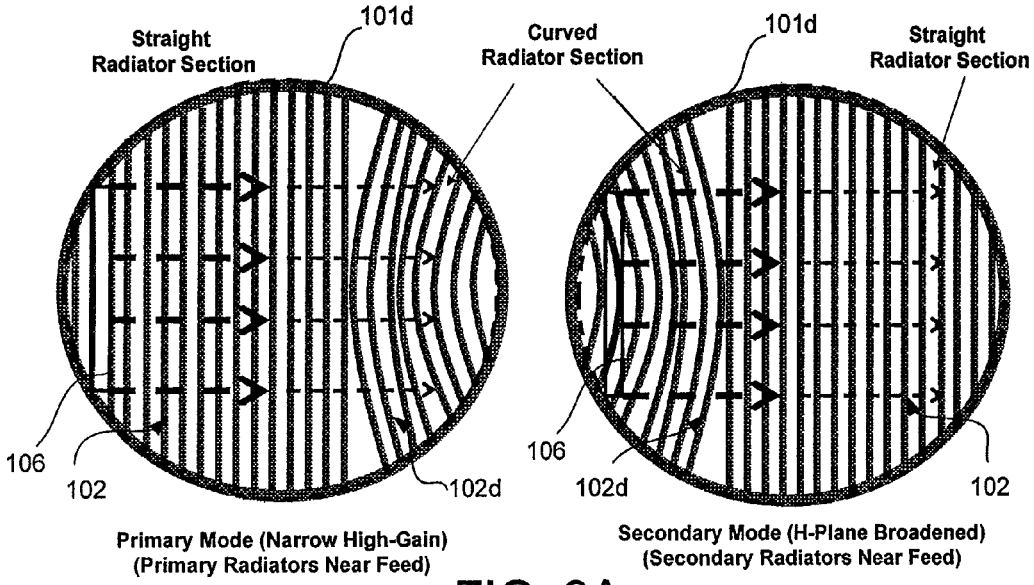
FIG. 9A illustrates primary and secondary mode switching via rotation of radiator structure, where a portion of the radiator structure is curved and the remainder of the radiator structure is straight.

FIG. 9A illustrates another exemplary first (upper) conductive plate 101*d* of a VICTS array in accordance with the present disclosure. Again, the first (upper) conductive plate 101*d* may replace the conductive upper plate 1 shown in FIGS. 1-4. The first plate 101*d* includes a first set of continuous transverse stub radiators 102 arranged on a first surface of the plate 101*d*, and a second set of continuous transverse stub radiators 102*d* arranged on the first surface of the plate 101*d*. The first set of continuous transverse stubs 102 occupies a majority of the surface of the plate 101*d*, while the second set of continuous transverse stubs 102*d* occupies a minority of the surface of the plate 101*d*. The stub radiators 102*d* in the minority region of the plate 101*d* are curved, non-uniformly spaced and/or have increased/heavily coupling stub radiators 102*d* (e.g., they may be dimensionally larger than the stub radiators 102), while the stub radiators 102 in the majority region may be straight and uniformly spaced.

Figure 9B:
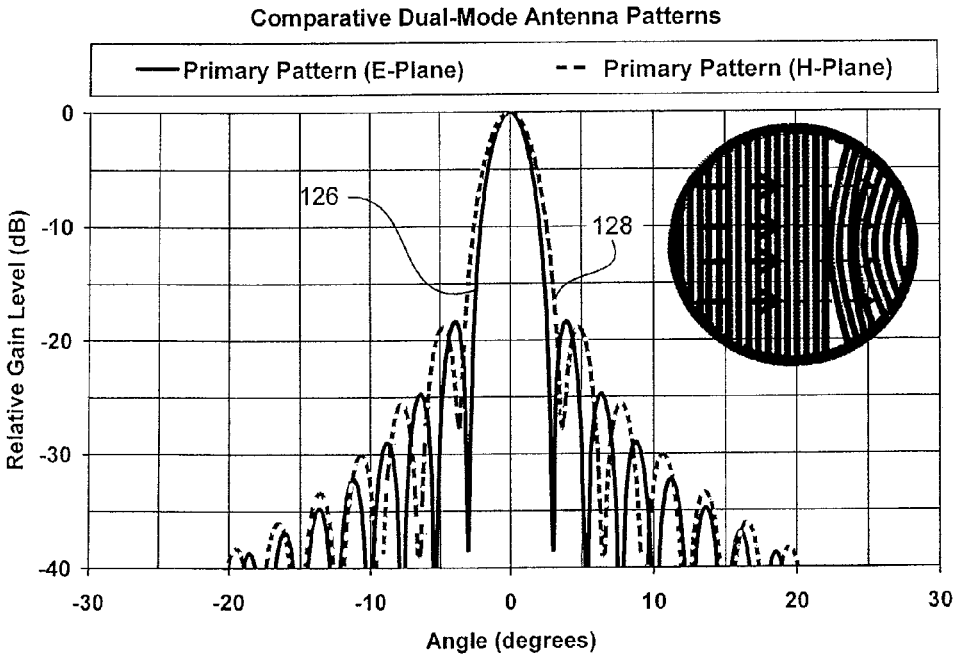
FIG. 9B is a graph showing the gain for a VICTS having the radiator structure of FIG. 9A while the curved pattern is distal from the feed network.
Figure 9C:
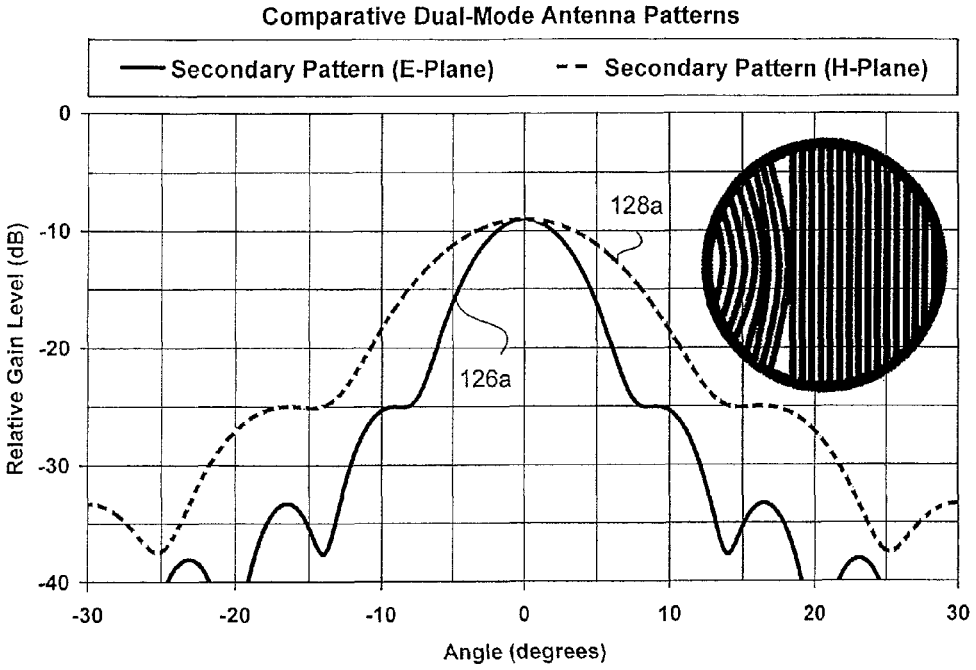
FIG. 9C is a graph showing the gain for a VICTS having the radiator structure of FIG. 9A while the curved pattern is proximal to the feed network.

The curved stub radiators 102*d* broaden the (H-plane) antenna pattern. The curvature attributes can be selected to provide the desired transverse (H-plane) phase properties in order to provide the desired beam-broadening and null-filling properties. FIG. 9B illustrates the primary antenna pattern for both the E-plane 126 and the H-plane 128 when the curved stub radiators 102*d* are distal from the feed network 106. Note that due to the size and remote location of the stub radiators 102*d* the net impact on the primary antenna pattern(s) is very small (as desired.) FIG. 9C illustrates the secondary antenna pattern for both the E-pane 126*a* and the H-plane 128*a* when the curved stubs 102*d* are proximal to the feed 106.

Figure 10A:
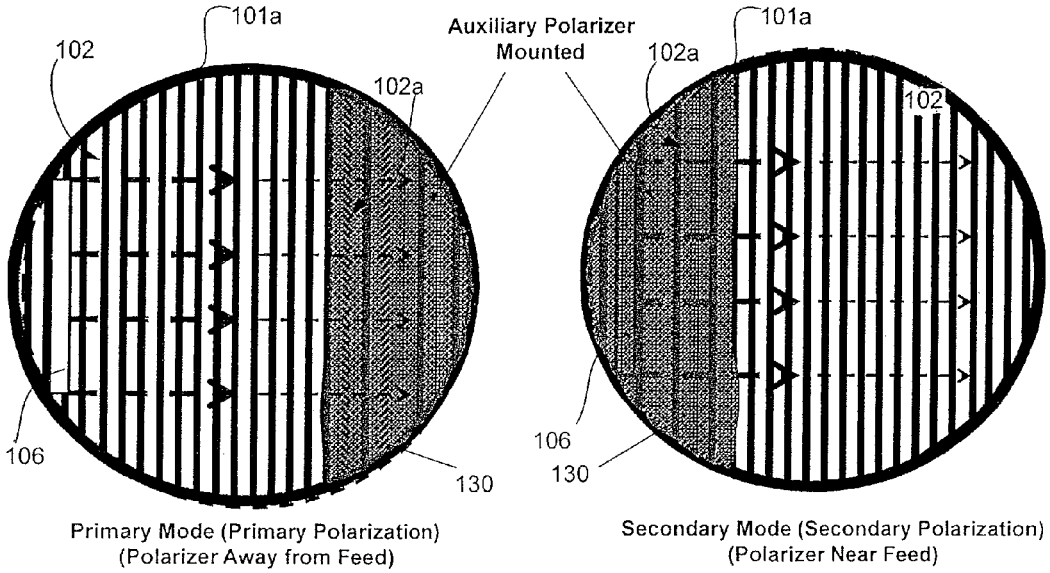
FIG. 10A illustrates primary and secondary mode switching via rotation of radiator structure, where a portion of the radiator structure includes a polarizer.
Figure 10B:
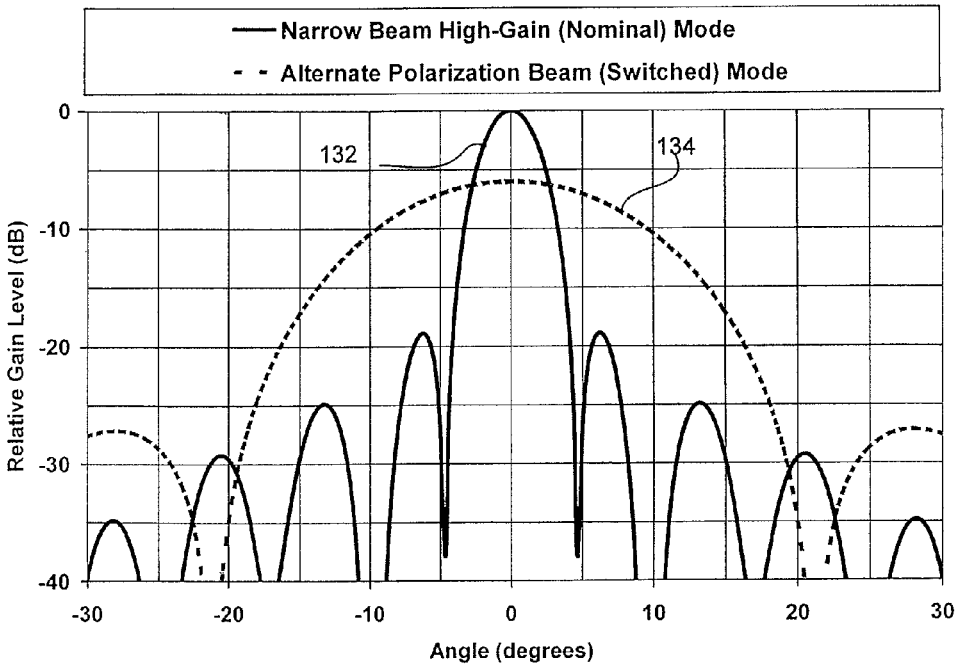
FIG. 10B is a graph showing the gain for a VICTS having the radiator structure of FIG. 10A, with one antenna pattern being narrow (higher-gain) and the other antenna pattern being broad (lower-gain) and having different polarization properties.

Moving now to FIG. 10A, another embodiment in accordance with the present disclosure is illustrated. The embodiment shown in FIG. 10A is similar to that of FIG. 6A, except that the second set of continuous transverse stub radiators 102*a* are covered with a polarizing surface 130. The polarizing surface 130 can tailor the polarization properties of the minority region (secondary beam) to be different than the properties of the majority region (primary beam.) The polarizer(s) employed in this particular embodiment can be selected and mounted using conventional means and methods. FIG. 10B illustrates the distinct individual properties of the two different antenna patterns, one pattern 132 being narrow (high gain) and the other pattern 134 being broader (low gain) and having different polarization properties. Alternatively or in addition to the above referenced polarizer, the first set of continuous transverse stub radiators 102 may be covered with a polarizing surface.

Additionally or alternatively, the feed structure may be modified to further improve performance of the antenna array. For example, in order to maximize the dependence on proximity to the feed network 106, an accelerated coupling (which may be accomplished via reduction of the parallel-plate spacing near the feed network 106, thereby increasing local coupling) may be beneficial. Similarly, an increased parallel-plate spacing (reduced coupling) may be employed on the "load" end in order to more fully "inert" the secondary features of the radiating stub aperture when it is in the "unselected" position (i.e., away from the feed).

Accordingly, the multi-beam VICTS antenna in accordance with the present disclosure employs modifications to the radiating stub aperture and/or to the internal parallel-plate feed structure in order to provide and support the desired dual-beam functionality.

Although the invention has been shown and described with respect to a certain embodiment or embodiments, equivalent alterations and modifications may occur to others skilled in the art upon the reading and understanding of this specification and the annexed drawings. In particular regard to the various functions performed by the above described elements (components, assemblies, devices, compositions, etc.), the terms (including a reference to a "means") used to describe such elements are intended to correspond, unless otherwise indicated, to any element which performs the specified function of the described element (i.e., that is functionally equivalent), even though not structurally equivalent to the disclosed structure which performs the function in the herein exemplary embodiment or embodiments of the invention. In addition, while a particular feature of the invention may have been described above with respect to only one or more of several embodiments, such feature may be combined with one or more other features of the other embodiments, as may be desired and advantageous for any given or particular application.

What is claimed is:

1. An antenna array employing continuous transverse stubs as radiating elements, comprising:

a feed network for transmitting or receiving a signal to or from the first conductive plate;

a first conductive plate structure including a first set of continuous transverse stub radiators arranged on a first region of a first surface of the first conductive plate structure, and a second set of continuous transverse stub radiators arranged on a second region of the first surface, wherein i) an area occupied by the first region is larger than an area occupied by the second region, ii) the first region is located between the feed network and the second region, and iii) a geometry of the first set of continuous transverse stub radiators is different from a geometry of the second set of continuous transverse stub radiators;

a second conductive plate structure disposed in a spaced relationship relative to the first conductive plate structure, the second conductive plate structure having a surface parallel to the first surface; and a relative rotation apparatus operative to impart relative rotational movement between the first conductive plate structure and the second conductive plate structure.

2. The antenna array according to claim 1, wherein the relative rotation apparatus is operative to rotate the first plate to position one of the first set of continuous transverse stub radiators or the second set of continuous transverse stub radiators into proximity of the feed network.

3. The antenna array according to claim 1, wherein a first pitch of the radiating structures of the first set of continuous transverse stub radiators is different from a second pitch of the radiating structures of the second set of continuous transverse stub radiators.

4. The antenna array according to claim 3, wherein the first pitch and second pitch are uniform.

5. The antenna array according to claim 1, wherein a first pitch of the first set of continuous transverse stub radiators is periodic, and a second pitch of the second set of continuous transverse stub radiators is aperiodic.

6. The antenna array according to claim 1, wherein a width of the stub radiators of the first set of continuous transverse stub radiators is less than a width of the stub radiators of the second set of continuous transverse stub radiators.

7. The antenna array according to claim 1, wherein a height of the stub radiators of the first set of continuous transverse stub radiators is less than a height of the stub radiators of the second set of continuous transverse stub radiators.

8. The antenna array according to claim 1, wherein the stub radiators of the first set of continuous transverse stub radiators are arranged in straight sections, and the stub radiators of the second set of continuous transverse stub radiators are arranged in curved sections.

9. The antenna array according to claim 8, wherein the second set of continuous transverse stub radiators have non-uniform spacing.

10. The antenna array according to claim 8, wherein the second set of continuous transverse stub radiators have non-uniform height or cross section.

11. The antenna array according to claim 1, wherein a geometry of the second set of continuous transverse stub radiators differs from a geometry of the first set of continuous transverse stub radiators in at least one of size, height, thickness, spacing, or shape.

12. The antenna array according to claim 1, wherein at least one of the first set of continuous transverse stub radiators or the second set of continuous transverse stub radiators are non-uniform in at least one of height or cross-section.

13. The antenna array according to claim 1, wherein the second set of continuous transverse stub radiators is arranged at an outer perimeter of the first conductive plate.

14. The antenna array according to claim 1, further comprising a first polarizer corresponding to the first set of continuous transverse stub radiators.

15. The antenna array according to claim 14, further comprising a second polarizer corresponding to the second set of continuous transverse stub radiators, the first polarizer different from the second polarizer.

16. A method for using a variable inclination continuous transverse stub (VICTS) antenna array to provide a first antenna pattern and a second antenna pattern different from the first antenna pattern, the VICTS array including a feed network for transmitting and/or receiving a signal via radio frequency (RF) coupling, and a conductive plate structure having a first set of continuous transverse stub radiators arranged on a first region of a first surface and a second set of continuous transverse stub radiators arranged on second region of the first surface, wherein i) an area occupied by the first region is larger than an area occupied by the second region, ii) the first region is located between the feed network and the second region, and iii) a geometry of the first set of continuous transverse stub radiators is different from a geometry of the second set of continuous transverse stub radiators, the method comprising:

generating the first antenna pattern by positioning the conductive plate structure relative to the feed network to RF couple the first set of continuous transverse stub radiators to the feed network; and generating the second antenna pattern by positioning the conductive plate structure relative to the feed network to RF couple the second set of continuous transverse stub radiators to the feed network.

17. The antenna array according to claim 1, wherein the second region is located on a perimeter of the first conductive plate.

* * * * *